United States Patent [19]

Shinoda et al.

[11] 4,176,639

[45] Dec. 4, 1979

[54] EVAPORATIVE EMISSION SYSTEM FOR IMPROVING ENGINE STARTING CHARACTERISTICS

[75] Inventors: Osamu Shinoda, Toyota; Keiichi Okabayashi, Aichi; Takanori Nagai, Toyota, all of Japan

[73] Assignee: Toyota Jidosha Kogyo Kabushikikaisha, Aichi, Japan

[21] Appl. No.: 826,133

[22] Filed: Aug. 12, 1977

[30] Foreign Application Priority Data

Jun. 5, 1977 [JP] Japan ..... 52-056784[U]

[51] Int. Cl.[2] ..... F02M 33/02

[52] U.S. Cl. ..... 123/136; 251/137

[58] Field of Search ..... 123/136; 251/137

[56] References Cited

U.S. PATENT DOCUMENTS

| | | | |
|---|---|---|---|
| 2,842,334 | 7/1958 | Short | 251/137 |
| 2,875,780 | 3/1959 | Martin | 251/137 |
| 3,191,587 | 6/1965 | Hall | 123/136 |
| 3,221,724 | 12/1965 | Wentworth | 123/136 |
| 3,456,635 | 7/1969 | Hervert | 123/136 |
| 3,534,720 | 10/1970 | DuBois | 251/137 |
| 3,680,318 | 8/1972 | Nakajima et al. | 123/136 |
| 3,831,572 | 8/1974 | Csicsery | 123/136 |

*Primary Examiner*—Charles J. Myhre
*Assistant Examiner*—Andrew M. Dolinar
*Attorney, Agent, or Firm*—Browdy and Neimark

[57] ABSTRACT

An evaporative emission system for an engine includes a float chamber of a carburetor connected to a charcoal canister via an inlet port and an outlet port. The emission system is characterized in that an electromagnetic opening and closing mechanism for actuating a valve which selectively opens and closes the inlet port is controlled by a temperature-sensitive switch so that evaporation of low-boiling-point components of fuel and absorption thereof by the charcoal is prevented at low temperatures even in case of long periods during which the engine is not running. The starting characteristics of the engine are thus maintained.

6 Claims, 3 Drawing Figures

EVAPORATIVE EMISSION SYSTEM FOR IMPROVING ENGINE STARTING CHARACTERISTICS

BACKGROUND OF THE INVENTION

For preventing environmental pollution by motor vehicles there has been devised techniques preventing escape of evaporated fuel gases and vapors in addition to techniques for treating exhaust gases. For example, it is known to dispose a canister containing activated charcoal between a float chamber of a carburetor and a vapor separator of a fuel tank so that evaporated fuel gases and vapors in the fuel tank and in the float chamber are absorbed in the activated carbon in the canister, while the ignition key of the engine is OFF. While the engine is in the running state, the evaporated fuel gases in the canister are led into an engine by the negative pressure of an intake manifold.

More specifically, as conventional apparatus coping with the escape of fuel gases and vapors in automobiles, there has been provided an electromagnetic valve operating mechanism disposed between a charcoal canister and the float chamber of a carburetor. The valve is opened whenever the ignition key of the engine is OFF.

However in conventional known evaporative emission systems of the above-mentioned type, if the ignition key is kept in the OFF state continuously for a long period, such as 2 or 3 days, the low-boiling-point components (easily gasifiable components) in the gasoline of the float chamber 3 are reduced, and the starting characteristics of the engine are degraded, a distinct disadvantage.

SUMMARY OF THE INVENTION

It is a primary object of the present invention to overcome the above-noted disadvantage of conventional evaporative emission systems disposed between a float chamber of a carburetor and a charcoal canister.

Another object of the present invention is to provide an evaporative emission system which includes a temperature-sensitive switch in circuit with an electromagnetic valve operating mechanism.

An additional object of the present invention is to provide an evaporative emission system in which the opening and closing of an inlet port are controlled even when the engine is not running to prevent evaporation of low-boiling-point fuel components so as to improve the starting characteristics.

In accordance with the present invention, the foregoing objects, as well as others which are to become self evident below, are achieved by an evaporative emission system in which when an ignition key is turned to the ON to start an engine, an opening and closing valve of the evaporative emission system is closed with respect to an inlet port to isolate a float chamber of a carburetor from a charcoal canister and, when the ignition key is turned to the OFF position, the engine is turned off and control is performed by an engine operating temperature so that when the temperature of the coolant is higher than 50° C., for example, the electromagnetic operating mechanism is actuated to open the inlet port and introduce evaporated fuel gas and/or vapor from the float chamber into the charcoal canister and, when the temperature is lower than 50° C., the electromagnetic operating mechanism is actuated to close the inlet port so as not to introduce the gas and/or vapor from the float chamber into the charcoal canister. Using this evaporative emission system of the present invention, the engine can be very easily started, even after long periods when it has not been running and the control is performed based on the temperature of the float chamber, the water temperature, the cylinder temperature in the engine, oil pan or the like.

DETAILED DESCRIPTION OF THE PREFERRED EMBODIMENTS

Figure 1:
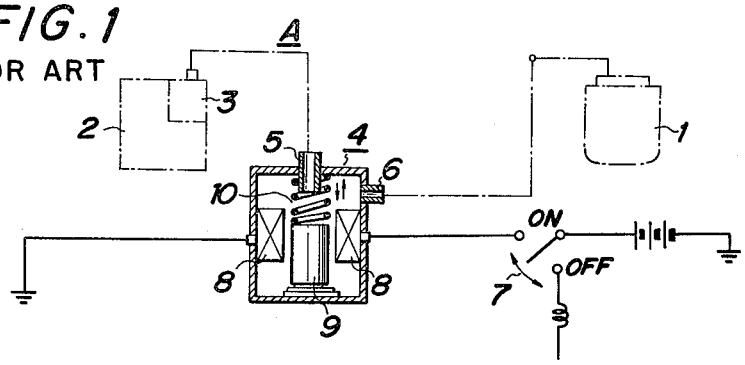
FIG. 1 PRIOR ART
FIG. 1 is a diagram illustrating a valve for opening and closing an inlet port, which valve is provided with an electromagnetic operation mechanism disposed between a float chamber of a carburetor and a charcoal canister in accordance with the prior art.

Before turning to a discussion of the illustrative embodiments of the present invention, the conventional known system referred to above is to be considered, reference being made to FIG. 1 which illustrates an evaporative emission system A in which an electromagnetic operation mechanism 4 is disposed between a charcoal canister 1 and a float chamber 3 of a carburetor 2, as is conventional.

In the evaporative emission system A, an inlet port 5 of the electromagnetic operation mechanism 4 is connected to the float chamber 3, and an outlet port 6 is connected to the charcoal canister 1. In this system A, when an ignition key 7 is placed in the OFF position and an automobile engine is in its unrunning state, no electricity is applied to a coil 8 and an opening and closing valve 9 is forced downwardly by a spring 10 to open the inlet port 5, whereby an evaporated fuel gas in the float chamber 3 is introduced into the charcoal canister 1 through the inlet port 5 and the outlet port 6 and is absorbed in the activated carbon. When the ignition key is put on, the electricity is applied to the coil 8 and the opening and closing valve 9 closes the inlet port 5 against the resilient spring 10 to disconnect the float chamber from the charcoal canister. Two embodiments and variants of the present invention are now to be described in detail, reference being made to FIGS. 2 and 3.

Figure 2:
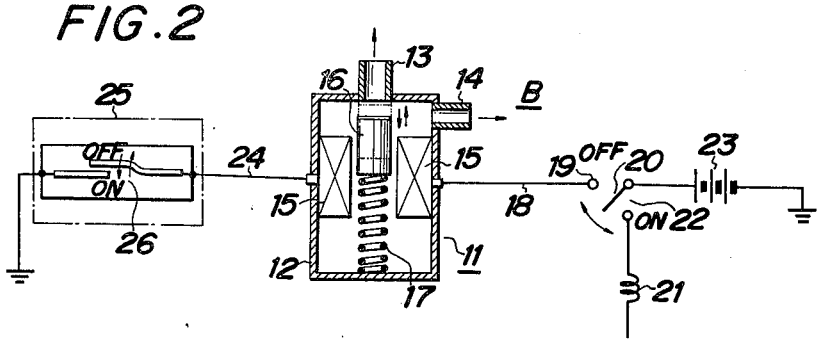
FIG. 2 is a diagram illustrating a first embodiment of an evaporative emission system in accordance with the present invention.

An evaporative emission system B of the present invention, as illustrated in FIG. 2, includes an electromagnetic operating system 11. An inlet port 13 connected to the upper portion of a casing 12 of the electromagnetic operating mechanism 11 is connected to a float chamber of a carburetor, as in the conventional arrangement shown in FIG. 1, and an outlet port 14, attached to the side face of the casing 12, is connected to a known charcoal canister, as mentioned above and shown in FIG. 1. A coil 15 is disposed in the casing 12, and a vertically movable magneto-sensitive opening and closing valve 16 is disposed concentrically with the coil 15 selectively to close the inlet port 13. A resilient spring 17 is positioned between the bottom face of the valve 16 and the bottom face of the casing 12. The coil 15 and the resilient spring 17 constitute an opening and closing valve operating mechanism.

One lead wire 18 of the coil 15 is connected to an OFF terminal 19, and an ignition key operated switch pole 20 is disposed so that it can be changed over between the OFF terminal 19 and an ON terminal 22 of an ignition coil 21. This ignition switch pole 20 is connected to a d.c. power source 23.

The other lead wire 24 of the coil 15 is connected to a water temperature-sensing switch 26 exposed to heat from a radiator 25. This switch 26 is arranged so that when the water temperature is, for example, higher than 50° C., it is turned ON and when the water temperature is lower than 50° C., it is turned OFF.

In the evaporative emission system having the above structure, when the ignition key-operated pole 20 is in the ON position, the wire 18 is unconnected from the power source 23 and no current is applied to the coil 15, irrespective of the position of the water temperature-sensing switch 26. Accordingly, the opening and closing valve 16 is lifted up by the resilient spring 17 to press against and close the inlet port 13 and isolate the float chamber 3 (FIG. 1) from the canister 1 (FIG. 1). In this state, the normal engine operation is conducted.

When the ignition key-operated pole 20 is in the OFF position, the coil 15 is connected to the power source 23 via the lead wire 18.

When the water temperature of the radiator 25 is higher than 50° C., the water temperature-sensing switch 26 is kept in its ON state, and accordingly, electric current is applied to the coil 15 and the opening and closing valve 16 is brought down against the force of the resilient spring 17. Accordingly, the float chamber 3 (FIG. 1) is communicated with the charcoal canister 1 (FIG. 1) through the inlet port 13 and the outlet port 14, whereby the evaporated fuel gas and/or vapor is absorbed in activated carbon of the canister 1 (FIG. 1) as is well known in the art.

When the engine remains in its unrunning state and the water temperature of the radiator 25 becomes lower than 50° C., the water temperature-sensing switch 26 automatically turns OFF and the electromagnetic operation mechanism 11 is kept in its nonoperative state, its circuit to the power source 23 having thus been opened. Accordingly, the opening and closing valve 16 is lifted up by the resilient spring 17 to close the inlet port 13 again, and communication between the float chamber 3 (FIG. 1) and the canister 1 (FIG. 1) is interrupted.

Accordingly, additional evaporated fuel gas and/or vapor from the float chamber 3 is not absorbed in the canister 1 via the ports 13 and 14 and, even if the engine remains in the non-running state for 2 or 3 days, low-boiling-point components of the fuel are not absorbed in the canister 1, and degradation of the starting characteristics of the engine effectively prevented. Therefore, if the ignition key-operated pole 20 is again turned to the ON position, the engine can be started under good conditions.

In this case, even when the inlet port 13 is closed, if the water temperature is lower than 50° C., the evaporation of the gas and escape of vapor from the float chamber 3 (FIG. 1) is maintained below a prescribed level, no problem is caused. The actuation temperature of the water temperature-sensing switch 25 may be appropriately set by a suitable adjusting mechanism.

The embodiment illustrated in FIG. 3 differs from the embodiment shown in FIG. 2 in the point that a second electromagnetic mechanism is disposed below the electromagnetic operating mechanism B. In this second embodiment, when the ignition key-operated pole 20 is set to the ON side 22, a coil 15' is not electrically connected to the power source 23 which is connected to a coil 15'' via a lead wire 18'', and opening and closing valve 16', 16'' is lifted up by the force of a resilient spring 17' and the force of a coil 15'' in order to close an inlet port 13'. Accordingly, the float chamber 3 (FIG. 1) is isolated from the canister 1 (FIG. 1) and the normal engine operation is conducted.

In opening, the valve 16' is pulled down by the magnetic force of the single coil 15'; in closing, the valve 16' is lifted up by the magnetic force of the coil 15'' and the resilient spring 17', acting together.

Thus, in the second embodiment (FIG. 3), the valve 16' is forced to close the inlet port 13' much more tightly than in the first embodiment (FIG. 2), wherein the valve 16 is forced to close the inlet port 13 using the single force of the resilient spring 17.

Consequently, as is well-known, when the engine vibrates during driving, it causes the evaporative emission system to also vibrate which can cause the port 13 to intermittently open.

Figure 3:
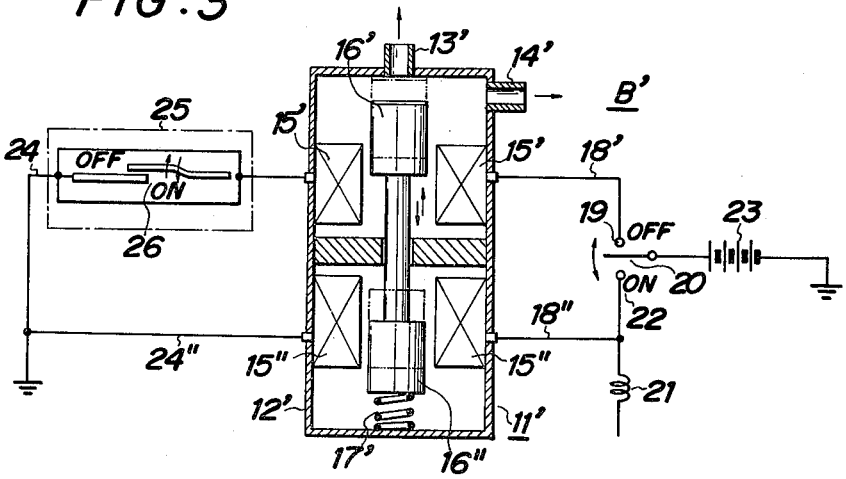
FIG. 3 is a diagram illustrating a second embodiment of an evaporative emission system in accordance with the present invention.

However, in the embodiment of FIG. 3 the valve 16' is tightly kept closed to the inlet pipe 13' against the forces resulting from the vibration, a distinct improvement over the arrangement using a single spring and valve as shown in FIG. 2.

When the ignition key-operated pole 20 is turned to the OFF side, the lead wire 18' is connected to the power source 23, and the lead wire 18'' is disconnected from the power source 23 to de-energize the coil 15''.

When the water temperature of the radiator 25 is higher than 50° C., the water temperature-sensing switch 26 is turned on and current is applied to the coil 15'. Accordingly, the opening and closing valve 16', 16'' is brought down against the force of the resilient spring 17' to open the inlet port 13', and as in the first embodiment, the evaporated fuel gas and/or vapor in the float chamber 3 (FIG. 1) is introduced and adsorbed in the canister 1 (FIG. 1) via the inlet port 13' and the outlet port 14'.

When the water temperature becomes lower than 50° C., the water temperature-sensing switch 26 turns off, and the coil 15' becomes de-energized, and the opening and closing valve 16', 16'' is lifted up by the resilient spring 17' to close the inlet port 13' and the float chamber 3 is isolated from the canister 1. Accordingly, evaporation of low-boiling-point components of fuel is prevented and even if the engine continues in its unrunning state for a long period of time, the engine can be started easily by turning the ignition key-operated pole 20 again to ON.

Of course, even by closing of the inlet port 13' at temperatures lower than the predetermined temperature, evaporation of the fuel in the float chamber 3 is inhibited as much as possible.

As is apparent from the foregoing, according to the present invention, the evaporative emission system is disposed between the carburetor and the canister, an electromagnetic operating mechanism which has operating means for a valve opening and closing the inlet port is disposed in an OFF circuit of the ignition key, and a temperature-sensing switch is disposed in this OFF circuit and is connected to the opening and closing valve operating means, whereby the inlet port is closed when the engine is started by turning the ignition key to its ON position, and the normal engine operation is performed, and when the ignition key is turned to its OFF position, the opening and closing valve opens the inlet port if the temperature is higher than the predetermined level, so that the evaporated fuel gas and/or vapor in the float chamber is introduced and adsorbed in the canister while preventing discharge of this gas and/or vapor outside from the system. When the temperature is lower than the predetermined level, the opening and closing valve closes the inlet port. Accordingly, if the engine continues in its unrunning state for a long period of time and the temperature is lowered, fluid communication between the float chamber and the canister is interrupted, and excessive adsorption of the vaporated fuel gas and/or vapor is prevented. As a result, evaporation of low-boiling-point components is prevented and even after long-time periods when not running, the engine can be started very easily and smoothly. This is the principal advantage achieved by the present invention.

Furthermore, the apparatus system has a very simple structure and it can be easily manufactured at a low cost, and a particular maintenance operation need not be conducted. This is a secondary advantage attained by the present invention.

It is to be understood that the foregoing discussion relates to illustrative embodiments of the present invention set out by way of example, not by way of limitation. Other embodiments and variants are possible without departing from the spirit and scope of the invention, its scope being defined by the appended claims.

What is claimed is:

1. An evaporative emission system comprising a carburetor, a canister, an ignition key-operated circuit which includes an ON circuit and an OFF circuit, an inlet port connected to said carburetor, outlet port connected to said canister; a valve means communicating said inlet port with said outlet port for opening and closing said inlet port comprising electromagnetic operating mechanism including two separately energized coils one being disposed in said OFF circuit of said ignition key-operated circuit and the other being disposed in said ON circuit of said ignition key-operated circuit, a single valve as closing and opening means against said inlet port coupled to said coils, means forming part of the system which exhibits an operating temperature thereof, and a temperature-sensing switch means in said OFF circuit of said ignition key-operated circuit and responsive to the operating temperature of said means forming part of the system for interrupting current to said electromagnetic mechanism when the operating temperature falls below a given value.

2. An evaporative emission system as set forth in claim 1, wherein said valve means includes a casing, and wherein said valve is equipped with a resilient spring, said spring being positioned between said casing and said valve.

3. An evaporative emission system, according to claim 1, wherein said temperature-sensing switch means is OPEN at temperatures below 50° C. and CLOSED at temperatures above 50° C.

4. An evaporative emission system, according to claim 1, wherein said means forming part of the system is a radiator, and wherein said temperature-sensing switch means is a water temperature-sensing switch mounted on said radiator.

5. An evaporative emission system according to claim 4 wherein said water temperature-sensing switch is OPEN at temperatures below 50° C. and CLOSED at temperatures above 50° C.

6. An evaporative emission system according to claim 1, wherein said temperature sensing switch means is disposed in said ignition key-operated circuit in series with one of said coils.

* * * * *